US007211006B2

(12) United States Patent
Chang

(10) Patent No.: US 7,211,006 B2
(45) Date of Patent: May 1, 2007

(54) GOLF CLUB INCLUDING STRIKING MEMBER AND ASSOCIATED METHODS

(76) Inventor: Dale U. Chang, 2900 Sun Bittern Ct., Windermere, FL (US) 34786

( * ) Notice: Subject to any disclaimer, the term of this patent is extended or adjusted under 35 U.S.C. 154(b) by 182 days.

(21) Appl. No.: 10/411,882

(22) Filed: Apr. 10, 2003

(65) Prior Publication Data

US 2004/0204265 A1 Oct. 14, 2004

(51) Int. Cl.
*A63B 53/04* (2006.01)

(52) U.S. Cl. ..... 473/329; 473/345; 473/326

(58) Field of Classification Search ..... 473/324–350, 473/290–291

See application file for complete search history.

(56) References Cited

U.S. PATENT DOCUMENTS 925,389 A * 6/1909 Royce ..... 473/329
3,172,438 A * 3/1965 Gianelli ..... 81/22
4,498,672 A * 2/1985 Bulla ..... 473/332
5,064,197 A * 11/1991 Eddy ..... 473/326
5,499,814 A * 3/1996 Lu ..... 473/329
5,505,453 A * 4/1996 Mack ..... 473/329
5,628,697 A * 5/1997 Gamble ..... 473/326
6,354,956 B1 * 3/2002 Doong ..... 473/219

* cited by examiner

*Primary Examiner*—Sebastiano Passaniti

(57) ABSTRACT

A golf club includes a golf club shaft and a golf club head connected to the golf club shaft. The golf club head includes a body having a forward surface and a striking member connected to the forward surface of the body. The striking member includes predetermined properties to deflect inwardly during initial contact with a golf ball and recover outwardly as the golf ball moves away substantially synchronized with compression and expansion of the golf ball. In some embodiments, the golf club head may include a spacer or neck connecting opposing medial portions of the body and the striking member. In other embodiments, the striking member may include a first layer and a second underlying layer disposed over the body.

31 Claims, 5 Drawing Sheets

GOLF CLUB INCLUDING STRIKING MEMBER AND ASSOCIATED METHODS

FIELD OF THE INVENTION

The present invention relates to the field of athletic equipment, and, more particularly, to the field of golf clubs and associated methods.

BACKGROUND OF THE INVENTION

Golf is a sport in which mastery of several skills are necessary in order to play successfully. For example, a more successful player is able to strike a golf ball with accuracy and with a sufficient amount of force so that the golf ball travels to the intended target. This is especially important during the initial drive of the golf ball. It is preferable to strike the golf ball using a center portion of a golf club head, which is generally referred to as the "sweet spot".

A golf ball will generally travel further when contact is made with the golf club head along the sweet spot. Making contact with the sweet spot, however, has been a source of frustration for many golfers. More particularly, an off center hit may cause the golf ball to travel a shorter distance, and in some cases, may cause the golf ball to veer off course, i.e., hook or slice.

An example of one type of golf club that attempts to compensate for off center hits is illustrated in U.S. Reissue Pat. No. 35,955 to Lu. The Lu golf club includes a golf club head having an insert with a deflectable striking member for striking the golf ball, and a corresponding element for supporting the deflectable striking member. This configuration, however, may be disadvantageous due to its complicated construction. Further, the configuration may add weight to the golf club head, causing the golfer to exert more force when swinging the golf club.

Other such golf clubs are illustrated in U.S. Pat. Nos. 6,390,932 and 5,672,120 to Kosmatka et al. and Ramirez et al., respectively. The Kosmatka et al. golf club includes a thin polymer coating over the striking face. Although the thick polymer coating is likely to be beneficial in protecting the striking face of the golf club, it may not be sufficient to compensate for off center hits. The Ramirez et al. golf club head includes a continuous fiber reinforced outer shell covering a core. This configuration, however, may make the golf club head quite cumbersome and somewhat heavy.

SUMMARY OF THE INVENTION

In view of the foregoing background, it is therefore an object of the present invention to provide a golf club for increasing energy transfer efficiency between the golf club and a golf ball when striking the golf ball.

It is also another object of the present invention to provide a golf club that compensates for off center hits.

These and other objects, features, and advantages of the present invention are provided by a golf club comprising a golf club shaft and a golf club head connected to the golf club shaft. The golf club head may comprise a body having a forward surface, and a striking member connected to the forward surface of the body. The striking member may include predetermined properties to deflect inwardly during initial contact with a golf ball and recover outwardly as the golf ball moves away substantially synchronized with compression and expansion of the golf ball. The synchronization of compression and expansion of both the golf club head and the golf ball advantageously increases energy transfer efficiency between the golf club head and the golf ball, which effectively increases golf ball travel distance.

In one embodiment of the present invention, the golf club head may comprise a spacer connecting opposing medial portions of the body and the striking member together to define a ring-shaped space between opposing portions of the body and the striking member. Both the spacer and the striking member may have a solid construction throughout. Preferably, the spacer is a neck-like member comprising a solid construction throughout or is hollow thin construction. The striking member may have an outer periphery substantially aligned with an outer periphery of the body. Further, the spacer may include a cross-sectional area in a range of about 5 to 90 percent of an area of the striking member. The striking member may comprise metal shell and may have a shell thickness in a range of about 0.25 mm (0.010 inch) to 5 mm thick (0.2 inch). The thickness of the metal may be the same as that of the conventional hollow metal driver head.

The striking member may deflect inwardly and recover outwardly when striking the golf ball for a time in the range of about 0.0001 to 0.0010 seconds. The body and spacer may also comprise metal. Further, the body, spacer, and striking member may be integrally formed as a monolithic unit. The golf club may further include a cover surrounding the body, spacer, and striking member.

The spacer may be made of one or more metal springs. The striking member is attached to the spring(s) such that it deflects inwardly by the spring(s) at golf ball impact and recover outwardly to impart additional bouncing effect to the golf ball. The springs may be in a shape of spiral or leaf as commonly known in the industry.

In another embodiment, the striking member may comprise a second layer over the forward surface of the body that comprises a second material and a first layer over the second layer that comprises a first material. The first and second materials may be selected and have predetermined thicknesses so that the first and second layers deflect inwardly during initial contact with a golf ball and recover outwardly as the golf ball moves away. The deflection and recovery of the golf club head striking surface are advantageously substantially synchronized with compression and expansion of the golf ball to increase the distance the golf ball travels after contact with the golf club head and to increase the surface area of the sweet spot.

In some embodiments, the second material may have a first resiliency in a medial portion and a second resiliency greater than the first resiliency in a peripheral portion to advantageously increase the surface area of the sweet spot on the golf club. The second material may comprise a synthetic elastomer and the first material may comprise a thermoplastic resin, for example. The first layer preferably has a thickness in a range of about 0.005 to 0.1 inch and the second layer preferably has a thickness in a range of about 0.125 to 2.0 inch. The golf club head striking surface may deflect inwardly and recover outwardly when striking the golf ball for a time in the range of about 0.0001 to 0.0010 seconds. The golf club head may have a shape so that the golf club is a driver or an iron.

A method aspect of the present invention is for making a golf club. The method may include forming a golf club head, and connecting the golf club head to a golf club shaft. Moreover, the golf club head may comprise a body having a forward surface, and a striking member connected to the forward surface of the body. As noted above, the striking member may have predetermined properties to deflect inwardly during initial contact with the golf ball, and recover outwardly as the golf ball moves away substantially synchronized with compression and expansion of the golf ball.

DETAILED DESCRIPTION OF PREFERRED EMBODIMENTS

Figure 1:
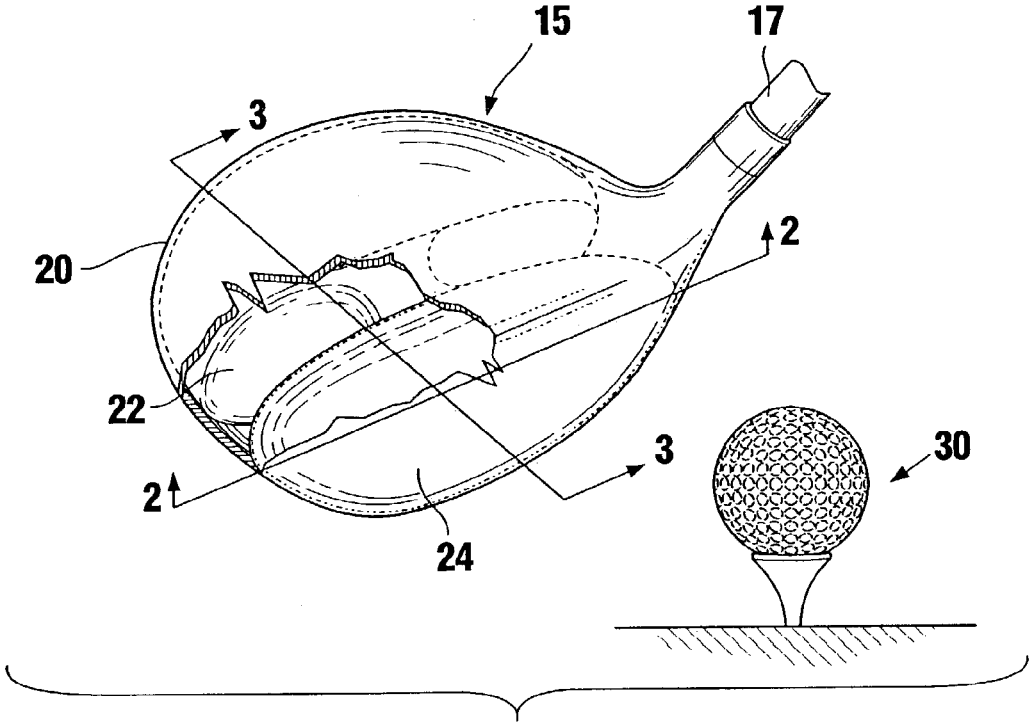
FIG. 1 is a perspective view of a first embodiment of a driver having portions of a cover cut away according to the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Referring initially to FIGS. 1–7, a golf club 15 according to the present invention is now described. The golf club 15 illustratively includes a golf club shaft 17 and a golf club head 20 connected to the golf club shaft. The golf club shaft 17 may comprise a high-strength, light-weight material, such as graphite or steel, for example, or any other material having similar properties as understood by those skilled in the art.

The golf club head 20 illustratively comprises a body 22 having a forward surface, and a striking member 24 connected to the forward surface of the body. The body 22 of the golf club head 20 generally comprises a high strength material capable of withstanding the force associated with striking a golf ball 30. The material may be composite material, titanium alloys, aluminum alloys, ceramics or steel, for example, or any other material having similar properties as understood by those skilled in the art. The striking member 24 has predetermined properties to deflect inwardly during initial contact with a golf ball 30 and recover outwardly as the golf ball moves away substantially synchronized with compression and expansion of the golf ball.

Coefficient of restitution (COR) is a measure of a bouncing effect. More specifically, and with respect to the present invention, COR of the golf club 15 is a measure of the bouncing effect of the golf club when striking a golf ball 30. For example, COR may be defined as a ratio of the golf ball speed before making contact with the golf club 15 to the golf ball speed after making contact with the golf club. COR may be expressed using the following formula:

$$e = \frac{v_2 - v_1}{u_1 - u_2}$$

In the above equation, e is the COR, $u_1$ is the velocity of the golf ball 30 before making contact with the golf club head, and $u_2$ is the velocity of the golf club 15 before making contact with the golf ball, $v_1$ is the velocity of the golf ball after making contact with the golf club, and $v_2$ is the velocity of the golf club after making contact with the golf ball.

Another way that COR may be approximated is by analyzing results of a "drop test" using the following formula:

$$e = \sqrt{\frac{h_2}{h_1}}$$

In the above formula, e, again, is the COR, $h_1$ is the height of the golf ball 30 before dropping it on a fixed club face, and $h_2$ is the maximum height of the golf ball recovery after being dropped.

Currently, the United States Golf Association (USGA) allows a COR for golf clubs of 0.83 when a golf club makes contact with a golf ball along a center portion of the striking face under the USGA test conditions, otherwise known as the "sweet spot". The golf club 15 of the present invention, advantageously increases the area of the sweet spot of the golf club head 20 by increasing the COR along outer peripheries of the striking member 24. The golf club 15 of the present invention also advantageously increases golf ball travel distances by compensating for off-center hits.

Proper synchronization of the compression and expansion of the golf ball 30 and the golf club head 20 can be determined by analyzing the bouncing effect between the golf ball and the golf club head. More particularly, the bouncing effect may be analyzed by simplifying the golf ball 30 to a spring-mass system. In order to do this, the natural frequency of the golf ball 30 and the golf club head 20 must first be determined using the following formula:

$$f = \frac{1}{2\Sigma} * \sqrt{\frac{k}{m}}$$

In the above equations, f is the natural frequency of either the golf ball 30 or the golf club head 20, m is the mass of the object for which the frequency is desired, i.e., the golf ball or the golf club head, and k is the spring constant of the object for which the frequency is desired. An equivalent spring constant $k_{eq}$ may be calculated for the instant at which the golf ball 30 and golf club head 20 are in contact using the following formula:

$$k_{eq} = \frac{(k_{ball} * k_{head})}{(k_{ball} + k_{head})}$$

Accordingly, the natural frequency $f_{eq}$ of the golf ball 30 and golf club head 20 may be expressed using the following formula:

$$f_{eq} = \sqrt{\frac{k_{eq} * (m_{ball} + m_{head})}{(m_{ball} * m_{head})}}$$

By synchronizing the compression and expansion of the golf club head 20 and the golf ball 30, the COR may be maximized. The degree of synchronization may be increased along outer peripheries of the striking face of the striking member 24 to thereby increase the surface area of the sweet spot.

The center portion of the face may have less exact synchronization compared with that of peripheral area of the striking face such that the center hits will not exceed the USGA limit of 0.83 COR. To maintain the same COR of 0.83 for the off-center hits, the degree of the synchronization should be higher on the peripheries of the striking face of the striking member 24 to compensate for less efficient energy transfer. Typical natural frequency of the ball and the club head striking face may be 500 Hz (cycles/sec) to 2,000 Hz, 1,000 to 1,200 Hz being the most common frequency.

Since the golf ball mass and the club head mass do not change, one can change the local spring rate, k, of the striking face to vary the natural frequencies of different areas of the club face. For instance, if the natural frequency of the ball is 1,000 Hz, the center portion of the striking face may have natural frequency of 900 Hz to stay within the overall COR limit of 0.83 while the natural frequency of periphery area of the striking face should be 1,000 Hz to increase the local COR. Exact synchronization on the periphery is necessary to compensate for less efficient energy transfer of off-center hits. In this way, the effective COR of the club face will stay close to the limit of 0.83 regardless of the ball contact location on the club's striking face.

A sweet spot having increased surface area advantageously increases golf ball striking distances for off-center hits. Providing a higher COR along outer peripheries of the striking member 24 also advantageously reduces or minimizes energy loss during contact between the golf ball 30 and the striking member.

Turning now more specifically to FIGS. 1–4, a first embodiment of the golf club 15 according to the present invention is now described. In the first embodiment of the golf club 15, the golf club head 20 illustratively includes a spacer 32 connecting opposing medial portions of the body 22 and the striking member 24 together to define a ring-shaped space between opposing portions of the body and the striking member. The ring-shaped space between the striking member 24 and the body 22 allows the striking member to deflect inwardly during initial contact with a golf ball 30 and outwardly as the golf ball moves away substantially synchronized with compression and expansion of the golf ball.

The general shape of the club head is typical "hollow driver head". The club or the driver head is hollow in the middle and is made of a thin shell structure as commonly used in metal drivers and fairway woods. The difference is that the mid-section of the head is "squeezed" or necked inwardly such that the body 22 and the striking member 24 are connected by the neck or spacer 32. Since the entire club head 20 is made of thin shell, the center portion of the striking member relies on face flexing for higher COR and the peripheral portion of the striking member secures the spring-like effect from the bending of the striking member around the spacer.

Both the spacer 32 and the striking member 24 illustratively include a thin shell construction or a solid construction throughout. More particularly, the body 22, spacer 32, and striking member 24 may be integrally formed as a monolithic unit for additional strength. Further, the striking member 24 illustratively has an outer periphery substantially aligned with an outer periphery of the body 22. In all cases, the total weight of the driver head should not be too heavy or too light for golfers, preferably around 6–8 oz. In this respect, the thin shell construction is preferred over solid construction. Thin shell construction allows a larger head size compared with solid construction for the same weight. Any combination of the body and the striking member is possible, i.e. the striking member 24 is of a thin wall structure while the body is of solid construction, or vise versa.

The entire golf head 20 may be constructed in the form of hollow structural "shell" as is the case with the present metal driver head. i.e. the metal woods and drivers are metal shell with empty mid-section, which is commonly called "hollow driver". The striking member 24 is typically 1.5 mm to 4 mm thick made of high strength materials such as Titanium alloys and high strength stainless steels. The thin striking member 24 flexes as it strikes the ball 30. This flexing is supposed to add to the COR. The COR increase will come from the thinness of the face, which allows more flexing than thick face. With the prior art drivers, the spring-like effect is only effective when the ball contacts the striking face at the sweet spot. For off-center hits, the flexing effect is reduced substantially or almost non-existing because the peripheral area does not flex as the central area (sweet spot) does.

Figure 2:
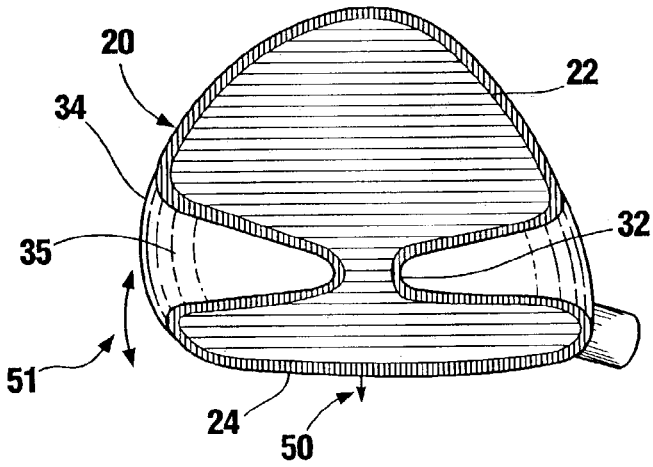
FIG. 2 is a cross sectional view of the driver taken through line 2—2 in FIG. 1.
Figure 3:
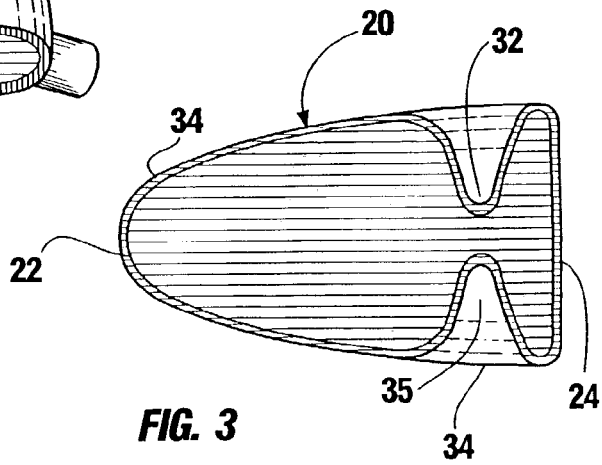
FIG. 3 is a cross sectional view of a driver taken through line 3—3 in FIG. 1.
Figure 4:
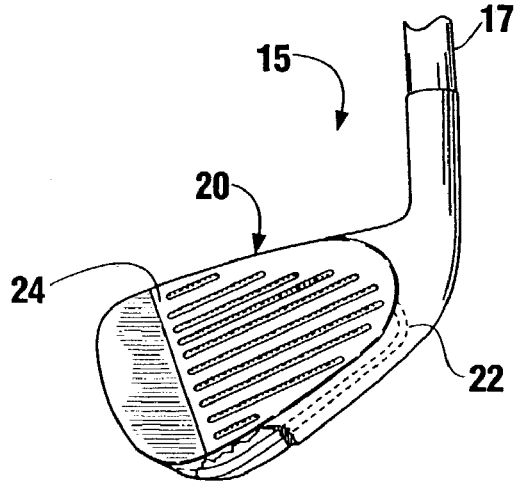
FIG. 4 is a perspective view of a first embodiment of an iron having portions of a cover cut away according to the present invention.

The present invention is designed to add the spring-like effect for the off-center hits by providing the desired spring-like effect through bending of the striking member 24. The increased COR is achieved by face flexing for the center hits, while the increase of COR is achieved by bending and bouncing back of the striking member 24 around the spacer 32. In other words, regardless of the ball striking position on the striking face, one can secure the desired spring-like effect, either by face flexing or striking member bending or any combination of them depend on the ball contact position. Face flexing 50 and striking member bending 51 are shown in FIG. 2.

The first embodiment of the golf club 15 provides a higher COR for the outer periphery of the striking member 24 and a lower COR for the medial portion of the striking member. More specifically, the COR of the striking member 24 as a whole is preferably close to 0.83. The face flexes inwardly like an empty metal can for spring-like effect. Accordingly, the striking member 24 preferably includes a COR of 0.83 along medial portions of the striking member 24, and a COR between the range of about 0.87 or higher along outer peripheral portions of the striking member for instance. Higher COR is desired on the periphery of the striking member to compensate for less efficient momentum transfer of off-center hits compared with center (sweet spot) hits. The spacer 32 and striking member 24 of the first embodiment of the golf club 15 advantageously allows the striking member to flex by bending along outer peripheral portions and increase the COR along the outer peripheral portions. This advantageously increases golf ball travel distance while simultaneously increasing the surface area of the sweet spot.

In other words, the center portion of the striking member relies on thin face flexing for the spring-like effect, while the peripheral areas rely on bending of the striking member around the neck for the desired spring-like effect. Again, the spring-like effect must be more on the periphery than the center portion so that the entire striking surface shows the same COR regardless of ball contact position. The overall target COR is currently 0.83 as USGA specified.

The spacer 32 has a cross-sectional area between ranges of about 5 to 90 percent of the area of the striking member 24, as long as the spacer (or neck) flexes to impart bouncing effect to the ball when it makes a contact on periphery of the striking member 24. The body 22, spacer 32, and striking member 24 may comprise a metal material, for example, or any other type of material having properties suitable for withstanding the force of striking the golf ball 30 without failure as understood by those skilled in the art. The shell thickness of the striking member 24 is between the ranges of about 0.010 to 0.20 inch.

The striking member 24 deflects inwardly and recovers outwardly when striking the golf ball 30 for a time in the range of about 0.0001 to 0.0010 seconds. More particularly, the golf club 15 of the present invention advantageously increases the contact time between the striking member 24 and the golf ball 30. The contact time between the striking member 24 and the golf ball 30 may be increased compared to the contact time associated with traditional non-flexing face of golf clubs.

The compression and expansion of the striking member 24 is synchronized with the compression and expansion of the golf ball 30 to advantageously provide a "spring-like" effect between the striking member and the golf ball, or more specifically, to increase energy transfer efficiency. The increased energy transfer efficiency advantageously increases golf ball travel distance. The golf club 15 further illustratively comprises a cover 34 surrounding the body 22, spacer 32, and striking member 24. The spacer 32 may be covered with a flexible cover to make the head look like one piece and to prevent dirt from getting into the neck area. The cover 34 may be made of a flexible and resilient plastic or rubber material, for example.

Figure 5:
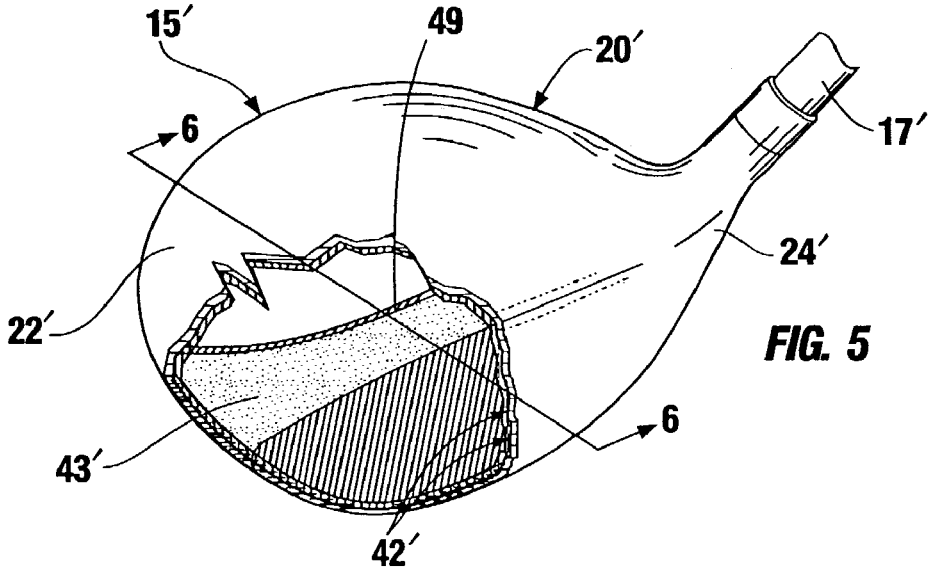
FIG. 5 is a perspective view of a second embodiment of a driver according to the present invention.
Figure 6:
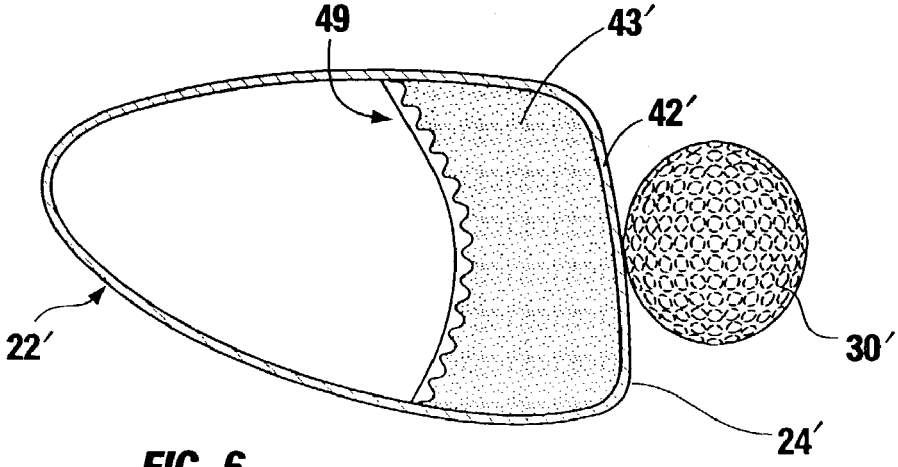
FIG. 6 is a cross sectional view of the driver taken through line 6—6 in FIG. 5.
Figure 7:
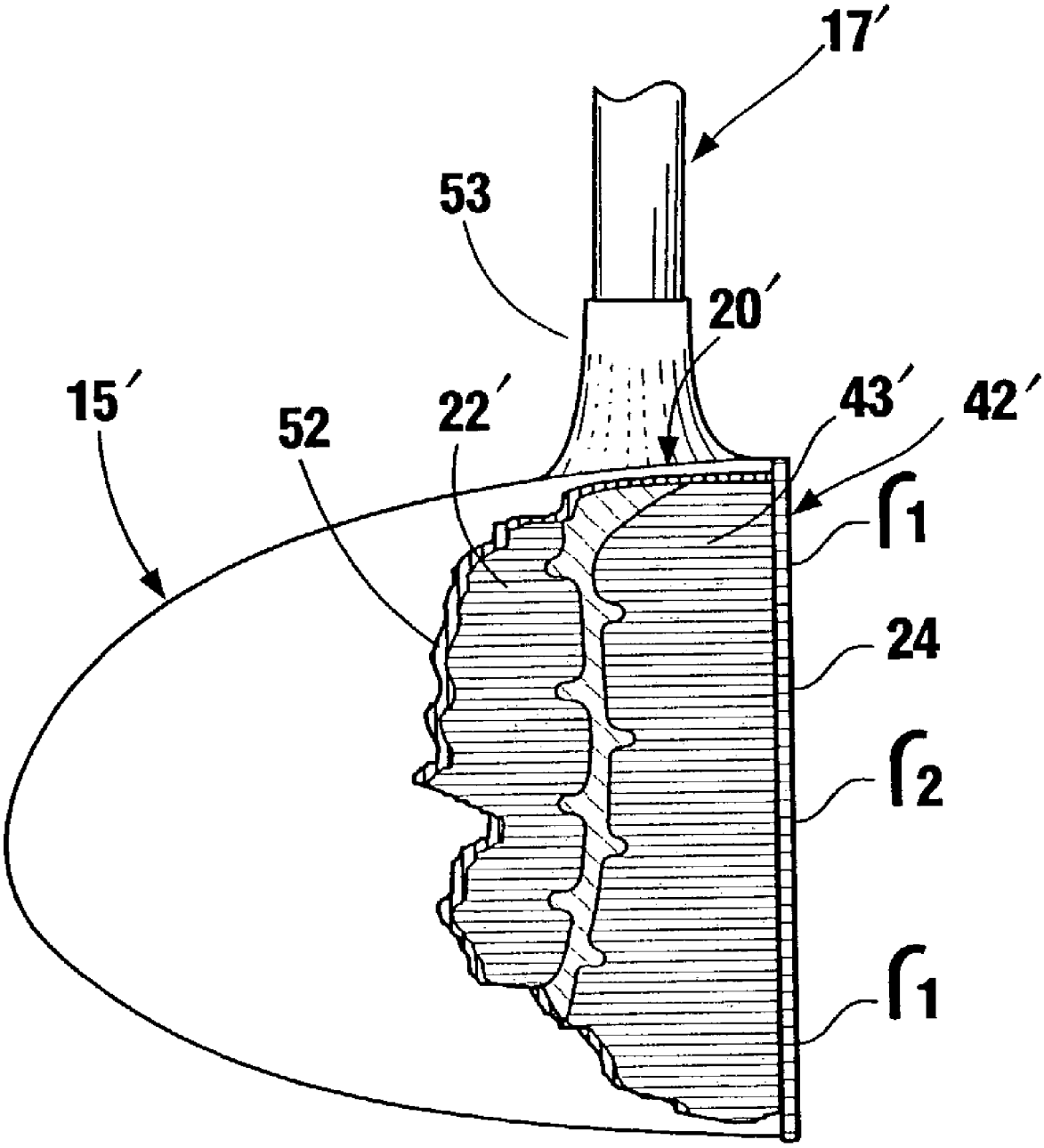
FIG. 7 is a perspective view of a variation of the second embodiment of a golf club head according to the present invention.

Turning now more specifically to FIGS. 5–7, a second embodiment of the golf club 15' is now described. In the second embodiment, the striking member 24' illustratively includes a first skin layer 42', that comprises a first material, over underlying thick core layer 43' that is secured on the forward surface of the body 22'. The thick core layer 43' comprises the second material. The first layer 42' and the second layer 43' have predetermined thicknesses so as to deflect inwardly during initial contact with a golf ball 30', and recover outwardly as the golf ball moves away from the striking member 24' after impact. The deflection and recovery of the striking member 24' is substantially synchronized with compression and expansion of the golf ball 30'.

The second material 43' comprises a highly resilient and elastic rubber or synthetic elastomer material. More particularly, the second material may be polybutadiene, for example, or any other material having similar strength and deformation properties, as understood by those skilled in the art. The second material may be attached securely on solid backing 49 of the body 22'. The solid backing 49 may have rough surface or ribs to hold the second material 43' as shown in FIG. 6. The first material 42' comprises a thermoplastic resin that is preferably scratchproof, and able to withstand cuts or other abrasions. The thermoplastic resin may, for example, may be Surlyn® by DuPont®, polyurethane, or any other material having similar properties, as understood by those skilled in the art.

As shown in FIG. 5 and FIG. 6, the thickness of the second material 43' may vary from the center portion to the periphery of the striking member 43', thus the peripheral area exerts more bouncing effect to the ball than the center area. This variation of thickness is designed to maintain the COR to 0.83 throughout the entire area of the striking face regardless of the location. The spring-like effect is thus increased around the periphery compared to the center to compensate for less efficient energy and momentum transfer of the off-center hits. The two figures show that the center portion is thinner, but the center portion may be either thinner or thicker depends on the synchronization of the ball and face bouncing.

Typical contact time between ball and club face is reported to be 0.00045 sec. This means that the natural frequency of the ball and the face need to be in the order of 1,111 Hz (cycles per second). The linear spring rate of the striking face needs to be approximately 4.32 times the linear spring rate of the ball. Assuming that the ball's spring rate is 12,000 lb/in when compressed to make a contact area of 1.125 inch diameter, the spring rate of the face needs to be 51,900 lb/in to synchronize the bouncing effect. Again, this synchronization of the bouncing effect will increase the COR, thus carry the ball further.

The material 43' may be chosen to suit particular ball that golfers use. Golf balls have different compression which is related to different spring rate. The material 43' may be selected to synchronize the bouncing effect of different compression balls, i.e. soft balls need soft striking face (material 43') and vise versa.

The second material 43' may be a composite material such that the resiliency is different from the center to the periphery. The thickness of the material 43' may be uniform in this case as oppose to the above case.

As perhaps best illustrated in FIG. 7, the first material may have a first resiliency $r_1$ in a medial portion, and a second resiliency $r_2$ in a peripheral portion. The second resiliency $r_2$ is preferably greater than the first resiliency $r_1$. Accordingly, the COR of the striking member 24 is higher along the outer periphery and lower along the medial portion. For example, the COR may be about 0.83 along the medial portion of the striking member 24 and in the range of about 0.86 to 0.90, along the outer periphery. This advantageously increases the surface area of the sweet spot to allow for greater golf ball travel distances. Higher COR is desired along the outer periphery to gain the same distance of the ball 30' regardless of the location of the ball contact area by compensating for an inefficient energy transfer or momentum transfer between the ball 30' and the striking face 24' for the off-center hits compared with sweet spot hits.

One variation of the second embodiment of the golf club is shown in FIG. 7. The second material 43' is molded around metallic bone or rib 52 that is an integral part of hosel 53. The second material 43' is covered with first material as skin layer to protect the club head from scratches and damages. In a sense, this club head is a large golf ball with reinforcing rib 52 inside that is connected to shaft 17' through hosel 53. FIG. 7 illustrates only one structural variation of applying the second embodiment of golf club head, any other structural variation having similar materials and construction is possible, as understood by those skilled in the art.

The configuration of the second material and the overlying first material is quite similar to the composition of a traditional golf ball 30', as understood by those skilled in the art. The compression and the resiliency of the materials may be different depends on the synchronization of the bouncing timing. Because of the shape factors, i.e. the ball is round while the striking face is flat, the resiliency of the striking face may be modified to synchronize the timing of the compression and expansion of the ball. It is important that the ball and the striking face substantially synchronize compression and recovery action to maximize the COR.

The first layer 42' preferably comprises a thickness in a range of about 0.005 to 0.10 inch and the second layer 43' preferably comprises a thickness in a range of about 0.125 to 2.0 inch. The first layer is to protect the striking face from scratches and tear, and may not be applied if the durability of the second material is sufficient for the striking member 24'. The bouncing effect of the striking member 24' comes mainly from the second core/underlying layer material 43', as can be expected. For this reason, the thickness of the layer 43' should be thick enough to impart strong elastic reaction to the golf ball 30'. The striking member 24' most typically deflects inwardly and recovers outwardly when striking the golf ball 30' for a time in the range of about 0.0001 to 0.0010 seconds. The golf club head 20, 20' may illustratively have a shape so that the golf club 15, 15' is a driver or an iron.

Figure 8A:
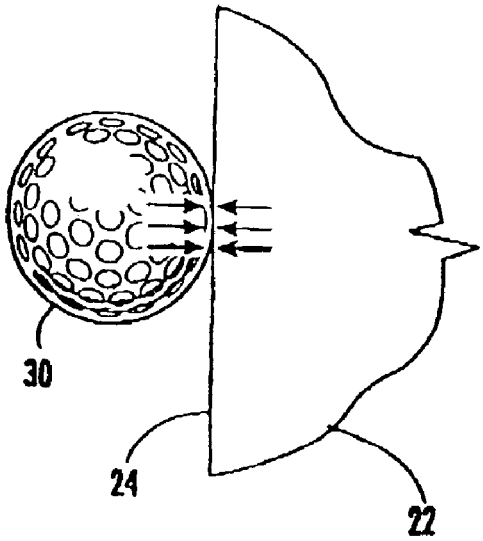
FIGS. 8A–8C are time-lapse illustrations showing the compression forces between the golf club shown in FIGS. 1–7 and golf ball.
Figure 8B:
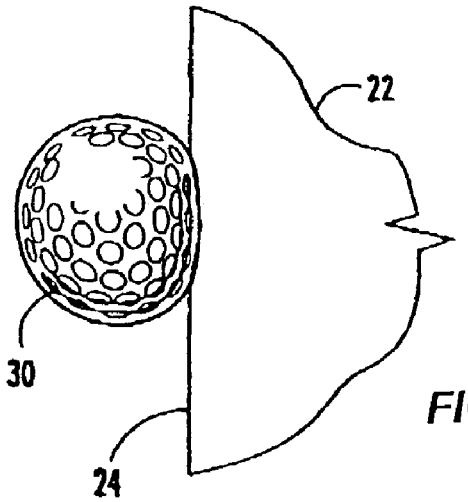
Figure 8C:
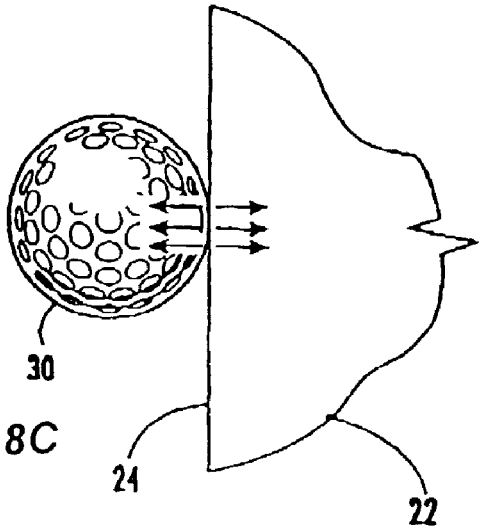

Turning now additionally to FIGS. 8*a*–8*c*, time-lapse illustrations showing the compression forces between the golf club 15 and the golf ball 30 are now described. More specifically, FIG. 8*a* is an illustration of the golf ball 30 making initial contact with the striking member 24 of the golf club 15. FIG. 8*b* is an illustration of the deformation of the golf ball 30 and the striking member 24 of the golf club 15 after the golf ball makes contact with the striking surface. FIG. 9*c* is an illustration of the golf ball 30 leaving the striking member 24 of the golf club 15 after contact. The golf ball 30 and the striking member 24 illustratively substantially return to their original shapes as the golf ball moves away from the striking member, after the transient shapes of bulge or elongation.

Figure 9:
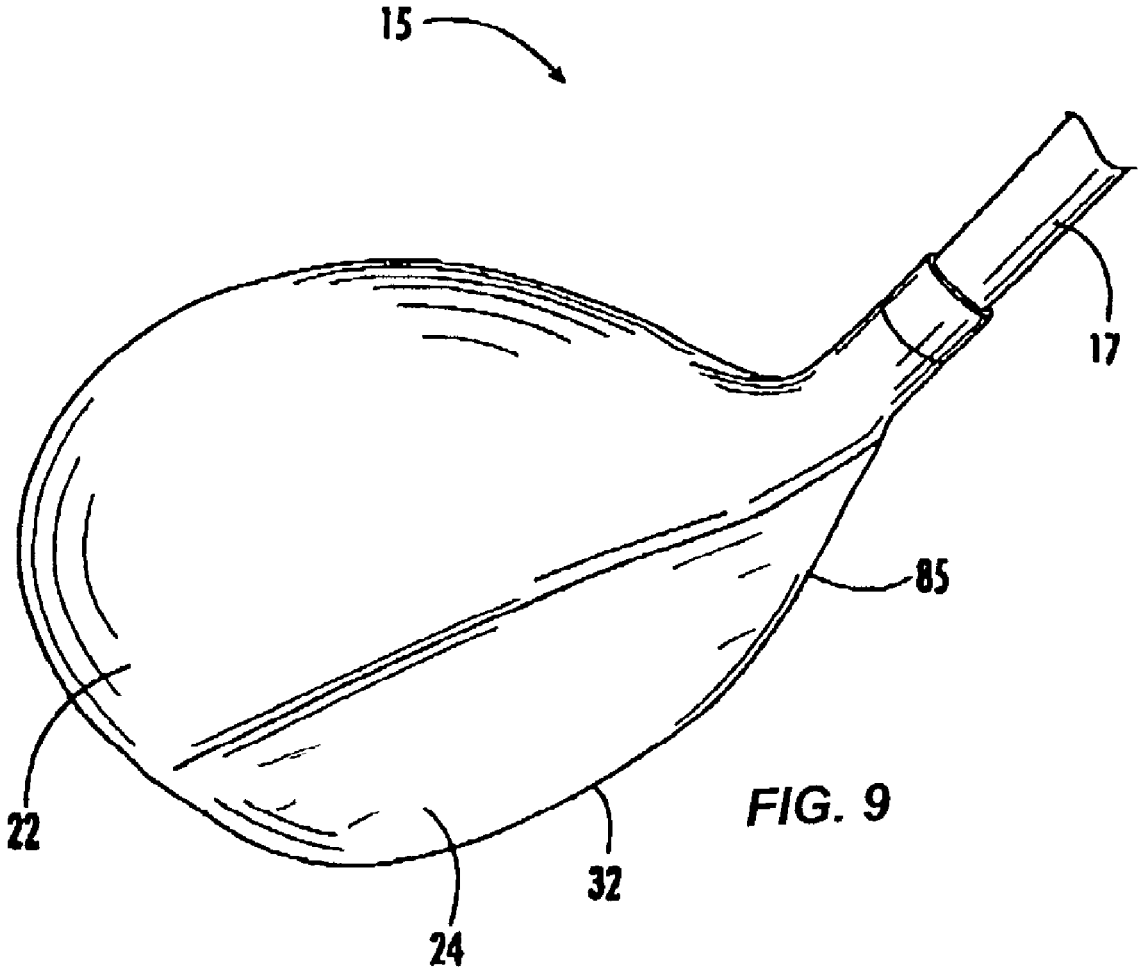
FIG. 9 is a perspective view of a driver having a substantially smooth striking member according to the present invention.

Turning now additionally to FIG. 9, another aspect of the present invention is described. To reduce hooking and slicing of the golf ball 30, i.e., veering to the left or right after contact with the striking member 24, it is desirable to reduce golf ball spin. Of course, golf ball travel distance is increased when golf ball spin is decreased. Accordingly, the striking member 24 of the golf club head 20 may advantageously be smooth to thereby reduce friction between the striking member and the golf ball 30 during contact. A reduction in friction advantageously reduces golf ball spin and increases golf ball travel distance.

A coating may also be applied to the striking member 24. The coating may be a low friction material, such as a Teflon or dry lubricant coating, for example, or any other material having similar properties, as understood by those skilled in the art. Similar to the smooth striking member 24, the coating advantageously decreases the friction between the golf ball 30 and the striking member 24 to thereby decrease golf ball spin and increase golf ball travel distance. More information regarding reduction of golf ball spin is disclosed in U.S. Pat. No. 6,402,636 titled "Golf Club for Minimizing Spin of Golf Ball" issued on Jun. 11, 2002, and U.S. patent application Ser. No. 10/122,873 titled, "Golf Club For Minimizing Spin Of Golf Ball", filed on Apr. 15, 2002 by the same inventor of the present application, the entire contents of which are incorporated herein by reference.

A method aspect of the present invention is for making a golf club 15. The method includes forming a golf club head 20, and connecting the golf club head 20 to a golf club shaft 17. The golf club head 20 comprises a body 22 having a forward surface, and a striking member 24 connected to the forward surface of the body. The striking member 24 includes predetermined properties to deflect inwardly during initial contact with a golf ball 30 and recover outwardly as the golf ball moves away substantially synchronized with compression and expansion of the golf ball.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims. The disclosures of all patents and other references cited herein are incorporated by reference in their entirety to the extent their teachings are not inconsistent with the teachings herein.

What is claimed is:

1. A golf club comprising:

a golf club shaft; and a golf club head connected to said golf club shaft and comprising a body having a forward surface, and a striking member having a striking surface, and a single medially disposed spacer connecting opposing respective medial portions of said body and said striking member;

whereby peripheral areas of the striking member bend around the spacer upon striking a golf ball, providing a desired bending and bouncing back of the striking member; and wherein the striking surface of said striking member deforms and deflects inwardly during initial contact with a golf ball and recovers outwardly as the golf ball moves away substantially synchronized with compression and expansion of the golf ball.

2. A golf club according to claim 1 wherein the spacer additionally is flexible upon the striking of the golf ball.

3. A golf club according to claim 2 wherein said spacer is springy to impart a bouncing action to the striking member.

4. A golf club according to claim 2 wherein said body, spacer and striking member are made of a hollow metal shell.

5. A golf club according to claim 2 wherein said spacer is made of one or more metal springs.

6. A golf club according to claim 2 wherein said golf club head further comprises a neck connecting opposing medial portions of said body and said striking member together to define a ring-shaped space between opposing portions of said body and said striking member.

7. A golf club according to claim 2 wherein said ring-shaped space between the opposing portions of said body and said striking member are covered with a flexible cover to make the whole golf club head to have an appearance of a one-piece design.

8. A golf club according to claim 2 wherein said spacer has a cross-sectional area in a range of about 5 to 90 percent of an area of said striking member.

9. A golf club according to claim 2 further comprising a cover surrounding said body, spacer, and said striking member.

10. A golf club according to claim 9 wherein said cover is made of a flexible and resilient plastic or rubber material.

11. A golf club according to claim 2 wherein the spring effect for center hits come from the face flexing while peripheral hits rely on bending of said striking member around said spacer.

12. A golf club according to claim 1 wherein said golf club head has a shape so that the golf club is a driver.

13. A golf club according to claim 1 wherein said golf club head has a shape so that the golf club is a fairway wood.

14. A golf club according to claim 1 wherein the striking surface of striking member is substantially smooth.

15. A golf club according to claim 1 wherein said spacer has a solid construction throughout.

16. A golf club according to claim 1 wherein said striking member has a solid construction throughout.

17. A golf club according to claim 1 wherein said striking member has an outer periphery substantially aligned with an outer periphery of said body.

18. A golf club according to claim 1 wherein said striking member comprises metal shell and has a thickness in a range of about 0.010 to 0.2 inch.

19. A golf club comprising:

a golf club shaft; and a golf club head connected to said golf club shaft, said golf club head having a shape so that the golf club is a driver, said golf club head comprising a body, a striking member having a striking surface, and a single medially disposed spacer connecting opposing respective medial portions of said body and said striking member together, effective to provide for the striking member and increased degree of natural flexing frequency synchronization with a golf ball impacting a peripheral portion, compared with a medial portion, of the striking member; and wherein the striking surface of said striking member deforms and deflects inwardly during initial contact with a golf ball and recovers outwardly as the golf ball moves away substantially synchronized with compression and expansion of the golf ball.

20. A golf club according to claim 19 wherein said body, spacer and striking member are made of a metal shell integrally formed as a monolithic unit.

21. A golf club according to claim 19 wherein said striking member has an outer periphery substantially aligned with an outer periphery of said body.

22. A golf club according to claim 19 wherein said spacer has a cross-sectional area in a range of about 5 to 90 percent of an area of said striking member.

23. The golf club of claim 19 wherein said body, spacer and striking member are integrally formed as a monolithic unit.

24. A golf club according to claim 19 wherein said body and spacer comprise metal. 9

25. A golf club according to claim 19 further comprising a cover surrounding said body, spacer, and said striking member.

26. A golf club according to claim 19 wherein said striking member comprises metal shell and has a thickness in a range of about 0.01 to 0.20 inch.

27. A golf club according to claim 19 wherein said spacer has a solid construction throughout.

28. A golf club according to claim 19 wherein said striking member has a solid construction throughout.

29. A golf club according to claim 19 wherein said striking member deflects inwardly and recovers outwardly when striking the golf ball for a time in the range of about 0.0001 to 0.0010 seconds.

30. A golf club comprising:

a golf club shaft; and a golf club head connected to said golf club shaft and comprising a body having a forward surface, and a striking member connected to the forward surface of said body, said striking member having a predetermined properties to deflect inwardly during initial contact with a golf ball and recover outwardly as the golf ball moves away substantially synchronized with compression and expansion of the golf ball wherein said golf club head further comprises a spacer connecting opposing medial portions of said body and said striking member, and wherein said body, said spacer and said striking member are made of a hollow metal shell.

31. The golf club of claim 30, wherein said body, spacer and striking member are integrally formed as a monolithic unit.

* * * * *